United States Patent [19]

Busch

[11] Patent Number: 4,572,045

[45] Date of Patent: Feb. 25, 1986

[54] HORIZONTAL AUTOMATIC PUNCHING MACHINE HAVING A GRIPPING/LIFTING ATTACHMENT AND A TRANSFER STATION

[76] Inventor: Gerhard Busch, Brookdamm 28, 2105 Seevetal 2 Meckelfeld, Fed. Rep. of Germany

[21] Appl. No.: 625,234

[22] Filed: Jun. 27, 1984

[30] Foreign Application Priority Data

Jun. 28, 1983 [DE] Fed. Rep. of Germany ..... 3323212

[51] Int. Cl.[4] ..... B65H 35/00

[52] U.S. Cl. ..... 83/97; 83/149; 83/154; 83/164; 83/165; 414/34; 414/735; 414/741

[58] Field of Search ..... 83/97, 151, 154, 164, 83/165, 149; 414/34, 735, 741, 744, 758, 776

[56] References Cited

U.S. PATENT DOCUMENTS 4,313,358 2/1982 Brown ..... 83/97

FOREIGN PATENT DOCUMENTS 616012 7/1978 U.S.S.R. ..... 83/97

*Primary Examiner*—Frank T. Yost

*Attorney, Agent, or Firm*—Oblon, Fisher, Spivak, McClelland & Maier

[57] ABSTRACT

An automatic punching machine having a gripping/lifting attachment which grips and lifts upright punched stacks from a delivery channel, turns them and deposits them onto transfer statics for further conveyance to an automatic bundling machine. The deposited stacks are held in the transfer station by stack guides. So that the stack guides do not interfere when the swivel arm of the gripping/lifting attachment, which is arranged so as to be turnable overhead through about 180°, is swung into the transfer station, such are fastened to a lifting table which can be lowered out of the plane of further conveyance. Mounted on the free end of the swivel arm is a swivel head which is pivotable through about 90° and which is provided with a parting knife for the dividing or separating of the stacks.

12 Claims, 8 Drawing Figures

HORIZONTAL AUTOMATIC PUNCHING MACHINE HAVING A GRIPPING/LIFTING ATTACHMENT AND A TRANSFER STATION

FIELD OF THE INVENTION

This invention relates to an automatic punching machine having a horizontal course of motion for punching pre-cut stacked or layered material which is pushed past a punch held on clamping arms into a linking delivery channel. A gripping/lifting attachment is associated with the delivery channel and a transfer station, arranged opposite the delivery channel, for further conveyance of the stacks which have been lifted away to an automatic bundling machine is associated with the gripping/lifting attachment.

DISCUSSION OF THE BACKGROUND

Such automatic punching machines have been known for a long time. For example, German Patent No. 279 610 discloses a punching machine which has an associated gripping/lifting device which conveys the punched material to an appropriate deposit. These known punching machines, however, are designed to deal with the punching of substantially horizontally-lying material, in which respect each sheet is individually gripped and lifted, punched and then further conveyed.

In the case of horizontal punching, each punching stroke brings about the punching of a fairly large stack of material all at once. The material to be punched is received in an approximately horizontally-lying delivery channel and is conveyed by the moving-up of material for punching as far as a gripping/lifting device which lifts off the punched stacks and places them onto a transfer station for futher conveyance to an automatic bundling machine. The material to be punched stands approximately perpendicularly in the delivery channel, but the angle of inclination of the individual punched sheets changes constantly as a result of friction in the channel, inherent curvature, expansion upon some stcaks being gripped and lifted away, different shapes of the punched sheets and so forth, so that the gripping device often is not properly inserted between two sheets, but encounters a sheet and damages it, which in turn entails disturbances in the production cycle. After they are fitted away, the stacks are to be bundled, i.e. surrounded with and held together by a band. This band is advantageously placed transversely to the surfaces of cut, but for this the stack has to be turned.

Often the punched material has non-uniform outer contours. For further conveyance the stacks are deposited at a transfer station which is provided with retaining rods which fit exactly into contour recesses. These retaining rods are intended to prevent, the individual sheets from shifting mutually or the entire stack from tilting over during subsequent conveyance.

However, these retaining rods often have to be placed at just those locations at which the gripping/lifting device needs a free space to enable it to deposit the stacks. In the past, therefore, irregularly shaped stacks have been inserted by hand into the transfer station or the automatic bundling machine. This is timeconsuming, monotonous and expensive.

SUMMARY OF THE INVENTION

The object of the invention is to provide, for an automatic punching machine of the kind described at the beginning hereof, a gripping/lifting attachment and a transfer station such that a stack of punched material once lifted away from the delivery channel can be rotated that a band can be placed over the cut edges and such that the retaining rods of the transfer station do not interfere during deposit of the stack at the transfer station.

This object is achieved by provision, in an automatic punching machine of the above mentioned type, of a gripping/lifting attachment which has a swivel head rotatable to and fro through about 90°, the swivel head also being arranged on a swivel arm which is swivelable overhead through about 180°, and of a transfer station provided with a lifting table which can be lowered out of the plane of futher conveyance.

As a result of these measures, a gripping/lifting attachment is provided by means of which a stack which is lifted away by the attachment can be so rotated and turned so that a subsequently-arranged automatic bundling machine can wrap a band therearound transversely to the cut edges, and a transfer station is provided in which during deposit of the stack there are no retaining rods in the working region to disturb the delivery by the gripping/lifting attachment. The lifting table which is lowered during delivery of the stacks is raised again only after delivery has been effected and the retaining rod or rods associated with the table then move easily into engagement with the contours of the stack.

In order to be able to securely grip even those stacks in which the individual sheets are curved, in one embodiment of the machine of the invention a protruding expanding mandrel, i.e. a mandrel having an increasing cross-section, is arranged adjustably on the cutting edge of a divider or parting knife. Upon operation of the knife, the expanding mandrel lies in front of the knife and initially encounters the stack with its pointed end. As a result of the shape of the expanding mandrel, the opening in the stack is increased in size and the following parting knife, which splits the stack up can be easily inserted between the divided stack that is to be lifted away and the stack strand coming from the punch knife.

In order to prevent striking of the mandrel against the delivery channel, when the mandrel is projected between sheets of the stack, the channel limb of the delivery channel which lies adjacent the gripping/lifting attachment consists, in the region of the attachment at least, of adjustable guide rods. These guide rods can on the one hand be adapted to the contours of the material to be punched (for example so-called champagne loops which stand perpendicularly in the stacks and which are placed around the bottle necks of champagne bottles) and on the other hand the distances between the respective guide rods can be varied if the expanding mandrel is adjusted in accordance with production requirements.

The individual sheets of the oncoming stack do not always stand perpendicularly. In order to set the stack in the region of the gripping/lifting attachment as perpendicular as possible to the insertion direction of the divider or parting knife, restraining devices for the material being punched, which devices are adjustable to any desired spacing from the channel limbs, are associated with the delivery channel in the region of the gripping/lifting attachment. These restraining devices decelerate the advancing stack strand to approximately the same extent as the delivery channel so that any obliquely orientated stacks are at this position righted and can be gripped and lifted off without any danger of damage to individual sheets.

In order to prevent the respective foremost shsets of the arriving stack strand from falling forwards, a holding-flat device is associated with one of the guide rods. In one embodiment, the holding-flat device consists of a bolt which acts against a spring arranged inside a hollow guide rod. The bolt is guided in a slot which is provided in this guide rod.

In order to prevent the swivel arm of the gripping-/lifting attachment from striking against the retaining rods of the transfer station, the lifting table is provided, on its upper side facing its frame, with retaining rods for retaining the deposited stacks and, on its underside, with coupling bolts for engagement with a coupling piece which is associated with the lifting cylinder.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
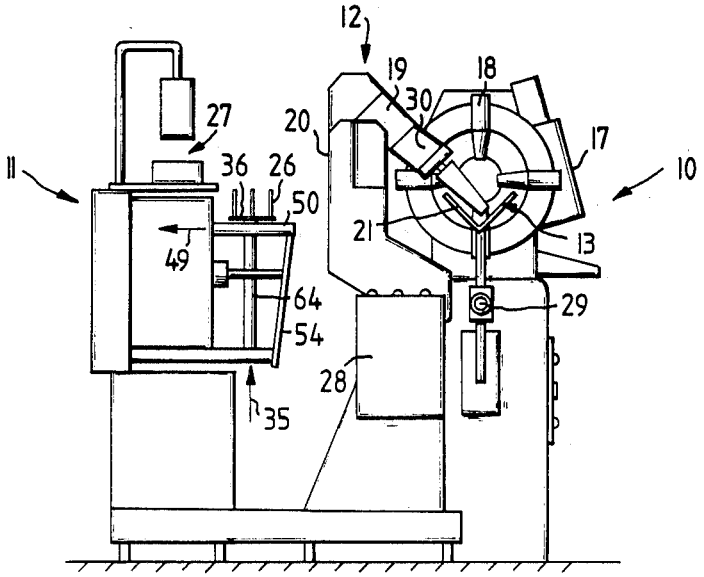
FIG. 1 is a schematic representation of one practical embodiment of an automatic punching machine of the invention having an associated gripping/lifting attachment and transfer and bundling stations.
Figure 2:
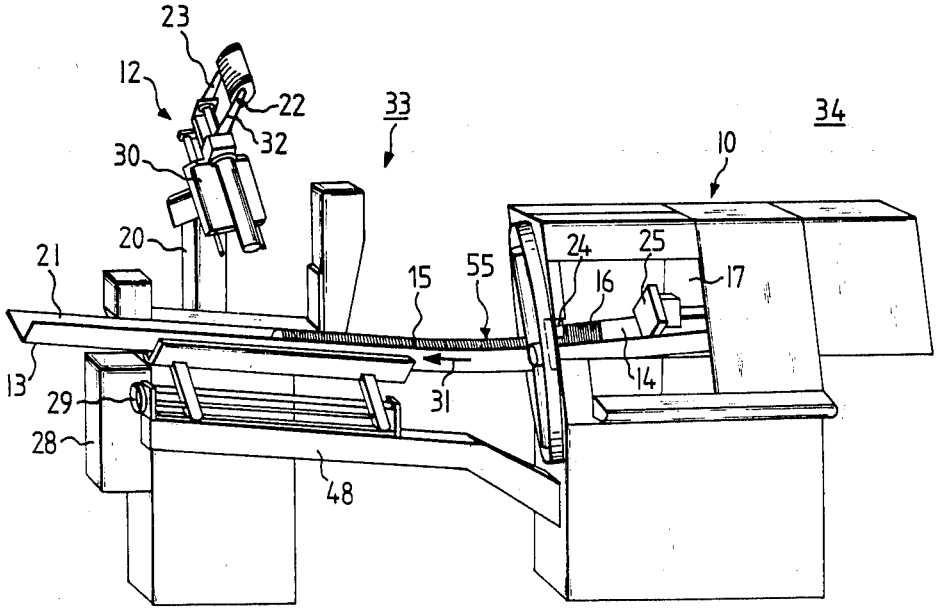
FIG. 2 is a schematic side view of the punching machine of FIG. 1 illustrating the gripping/lifting attachment.
Figure 3:
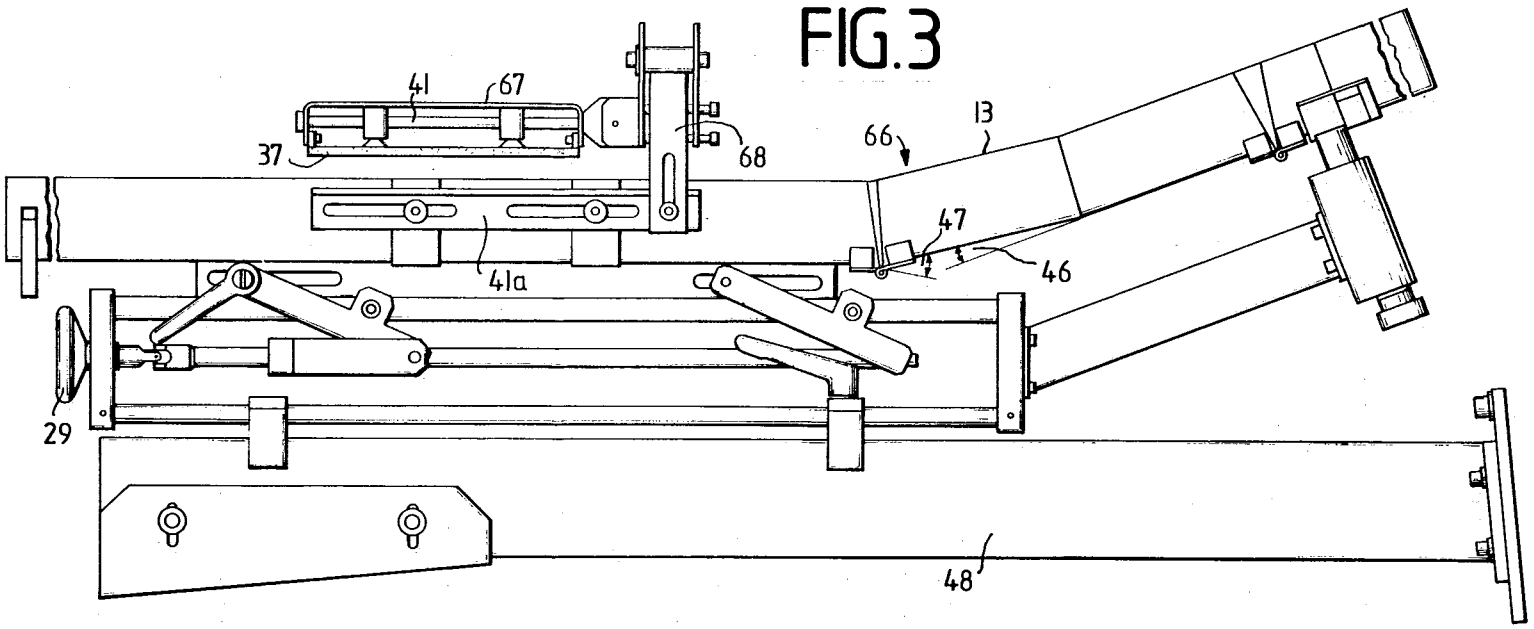
FIG. 3 is an enlarged side view of the delivery channel of the automatic punching machine of FIG. 1.
Figure 4:
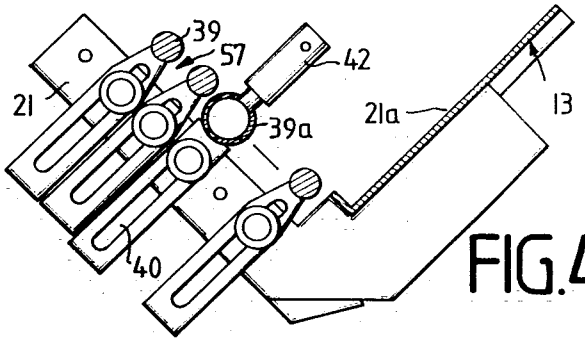
FIG. 4 is a front view, partially in cross-section, of the delivery channel of FIG. 3 illustrating the guide rods.

The automatic punching machine shown in FIGS. 1 and 2 comprises a punching chamber 17, in which an insertion channel 14 is arranged. The channel 14 leads to a punch or cutter 24 which is held on clamping arms 18. Raw, pre-cut stacks 16, for example of paper, are introduced into the insertion channel 14 with the planes of the individual sheets of the stack 16 approximately perpendicular to the base of the channel 14. The stacks 16 are forced by means of a press plate 25 past the punch or cutter 24. The punched stacks emerging from the punch 24 with the appearance of an endless snake 55 are received by a delivery channel 13 which is linked to the channel 14. As shown in FIG. 3, the delivery channel 13 has a first section with a slope 46 of about 20° relative to the central section. This first section links to the punch 24. The central section merges, into a second section of slight opposite gradient 47 of about 10°. The channel 13 is V-shaped in cross-section having respective flanks or limbs 21, 21*a* respectively, as shown in FIG. 4.

A gripping/lifting attachment 12 is associated with the automatic punching machine 10 in the region of the second section with gradient 47 of the delivery channel 13. This gripping/lifting attachment 12 comprises a support 20, at the upper end of which a swivel arm 19 is arranged so as to be swingable substantially overhead through about 180°. In the depicted initial gripping position, as shown in FIG. 1, the swivel arm 19 is in line with the channel limb 21 of the delivery channel 13.

At its free end, the swivel arm 19 carries a swivel head 30 which is pivotable in a generally vertical plane through about 90° as shown in FIG. 2, arranged on the swivel head 30 is a divider or parting knife 22, which is movable towards a stationary stack holder 23 in the direction of movement (arrow 31) of the punched stacks in its lowermost position. When the swivel arm 19 pivots downwardly to the delivery channel 13, the divider or parting knife 22 separates a punched stack 15 from the oncoming endless snake 55 ad subsequently the stack holder 23 grips the thus parted stack. The swivel arm 19 lifts this separated stack out of the delivery channel 13 by rotation of about 90° and then moves the same by swiveling through about 180° overhead in order to feed it to a transfer station 35, as indicated in FIG. 1. The separated stack 15 from the delivery channel 13 now lies with the planes of individual sheets substantially horizontal in the transfer station 35, which is shown in more detail in FIGS. 7 and 8.

The transfer station 35 has a lifting table 36, on which upright stack guides 26 are arranged adjustably on adjusting means 56. These stack guides 26 support and hold the transferred stack 15 when it is further conveyed in the direction of arrow 49 (FIG. 1) to a bundling station 27 of an associated automatic bundling machine 11. At the bundling station 27, the stack 15 has a band wrapped transversely around its punched edges and around the upper and lower sheet of material. As a result of the aforesaid rotation and turning and the subsequent wrapping round with a band over the punched edges, a bundle of punched labels is produced which represents a relatively stable, easy to manipulate unit for packaging.

The gripping/lifting attachment 12 is controlled by a control unit 28. Height adjustment means 29 is provided in order to be able to adapt the delivery channel 13 to different production conditions.

Figure 6:
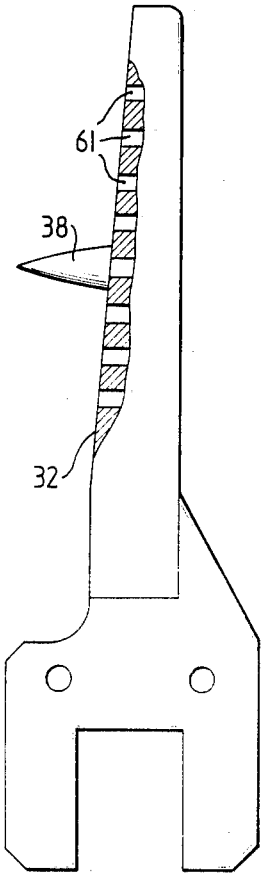
FIG. 6 is a diagram of a divider knife with a superimposed adjustable expanding mandrel.

When separating or dividing up the punched stack 15, the divider or parting knife 22 has to be inserted exactly between two sheets of material in order to avoid any damage to the labels. The cutting edge 32 of the parting knife 22 is, for this purpose, chromium-plated. In a modified embodiment, an expanding mandrel 38 i.e. a mandrel of increasing cross-section is associated with the divider or parting knife 22. This expanding mandrel 28 precedes the cutting edge 32 of the knife 22 and is shown in detail in FIG. 6. The expanding mandrel 38 is arranged in receiver slots 61 one of a number of which are provided along the cutting edge 32, in order to be able to extend at different locations into the snake 55 depending on production conditions. This expanding mandrel 38 will, for example, initially encounter curvedly arriving labels with its pointed end and then separate the stack by expanding the thus formed opening between two pieces of punched material. The following parting knife 22 can then stab into this expanded opening without damaging a label.

The labels emerging from the punch knife 24 are decelerated at thier underside which is in contact with the delivery channel 13. They therefore drop so as to have a slightly forward inclination which has to be compensated for if the divider or parting knife 22 is not to encounter a label side. It is for this reason that the delivery channel 13 changes gradients from the slope 46 before reaching the region of the gripping/lifting attachment 12. In the transitional region 66, the label stacks 15 are righted by a changeiin their angles of incidence, and they fall back into a position perpendicular to the channel limbs 21, 21*a*.

Restraining devices 41 are associated with the delivery channel 13 in the region of the gripping/lifting attachment 12, as shown in FIG. 3, as an additional means for righting the oncoming stacks 15. These restraining devices 41 consist of yokes 67 which can be brought by way of adjusting means 68 into a position relative to the channel limb 21 or 21*a* respectively which corresponds to the height of the stack 15 that is to be righted. The undersides of the yokes 67 facing the delivery channel 13 are provided with felt overlays 37 in order to increase the friction slightly to achieve the aforesaid result.

The channel limb 21 adjacent to the gripping/lifting attachment 12 is formed with guide rods 39, as shown in FIG. 4. The guide rods 39 are fastened to an adjusting mechanism 40, on which they can be positionally adjusted with regard to one another and relative to the opposite channel limb 21*a*. As a result of this adjustment the stacks 15 moving along the channel 13, which can consist, for example, of labels for bottle necks and can have curved outer contours, are supported around their curved edges. The interspaces 57 between the individual guide rods 39 can be varied in order to allow a free passage to the expanding mandrel 38 in the case of differing production requirements, so that the cutting edge 32 of the following divider or parting knife 22 can penetrate as far as the channel limb 21.

Figure 5:
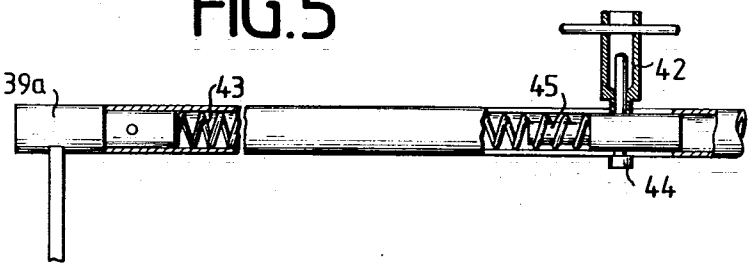
FIG. 5 is a diagram of a partially sectioned guide rod which is provided with a holding-flat device.

After the separating of the foremost stack 15, the immediately following labels of the arriving stack snake 55 have a tendency to fall forwards. Upon the next division or separation, they would then be encountered laterally by the parting knife 22 and be destroyed. In order to prevent this, one of the guide rods 39*a* as shown in FIG. 5, is hollow in design. Extending longitudinally within this hollow guide rod 39*a* is a spring 43 with which is associated a transversely extending bolt 44 with a holding-flat device 42 fastened to it. This holding-flat device 42; projects out of the guide rod 39 through a longitudinally extending slot 45 and is guided in said slot 45. The holding-flat device 42 holds the respective first label of each stack 15 flat until it is held by the stack holder 23. The entire delivery channel 13 is held in a predeterminable position by a channel support 48 which extends substantially perpendicularly to the direction of movement of the parting knife 22.

Figure 7:
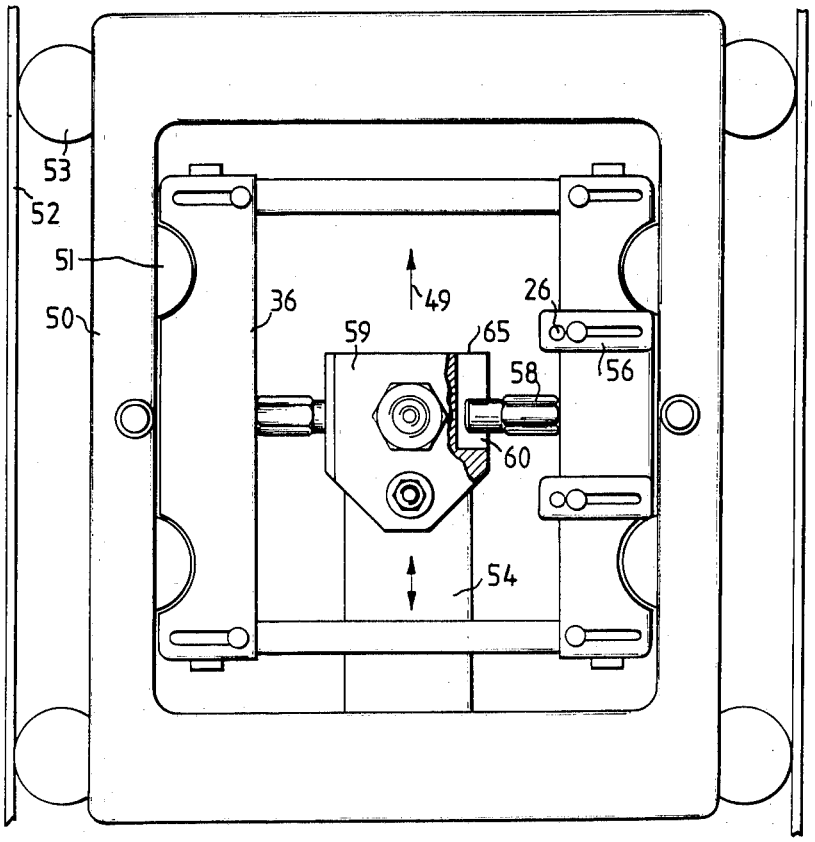
FIG. 7 is a plan view of a lowerable lifting table of the transfer station of the automatic punching machine of FIG. 1.

The transfer station 35 shown in FIG. 7 comprises a frame 50 which is reversibly movable along rails 52 on horizontally arranged rollers 53. The frame 50 is moved in the plane 49 (FIG. 1) by a guide arm 54. The lifting table 36 can be connected to this frame 50. This connection, in the exemplified embodiment is brought about with the aid of holding magnets 51. Upon raising of the lifting table 36, the holding magnets 51 strike against the frame 50 and hold it fast.

On its upper side 62 the lifting table 36 is provided with stack guides 26 which can be lowered together with said table 36. The stack guides 26 cannot, in the lowered state, impede the swing-in motion of the swivel arm 19 swinging-in for delivery to the transfer station.

Figure 8:
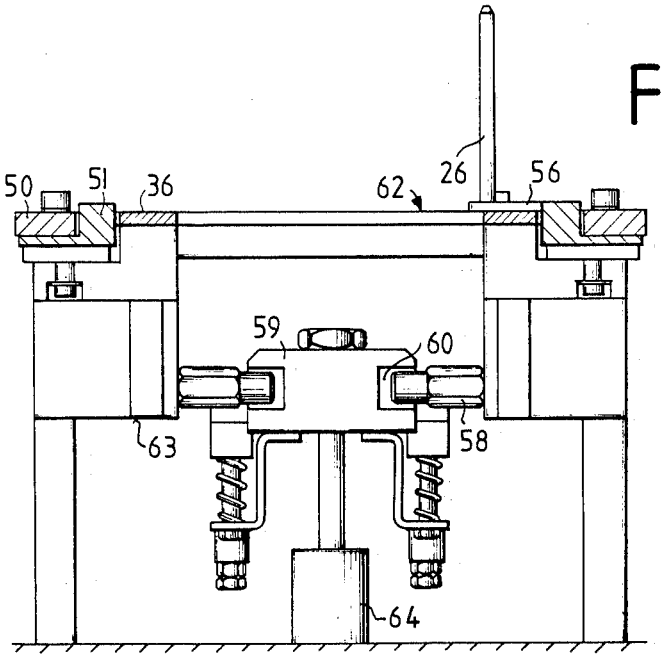
FIG. 8 is a cross-sectional view illustrating the coupling between the lowerable lifting table and the mobile frame of the transfer station.

On its underside 63 the lifting table 36 can be connected to a coupling piece 59, as shown in FIG. 8, by way of coupling pins 58. The coupling piece 59 is associated with a lifting cylinder 64 and can be moved up and down with same. The coupling pins 58 are arranged substantially horizontally and are associated with the lifting table 36. During lowering of the table 36 the coupling pins 58 engage into coupling slots 60 of the coupling piece 59. The coupling slots 60 have open sides 65 which face in the direction of the automatic bundling machine. If the frame 50 with the lifting table 36 held thereon by the holding magnets 51 is moved in the direction 49 of the automatic bundling machine 11, the coupling pins 58 can slide out of the coupling slots 60 and separate the lifting table 36 from the lifting cylinder 64.

A gripping/lifting attachment 12, as is shown in FIGS. 1 and 2 on the finished-part side 33 of the machine can also be associated with the raw-part side 34 of the machine. In this case, the divider or parting knife 22 initially horizontally removes pre-cut raw stacks 16, for example from a horizontally positioned store. This initially horizontally lying stack 16 is, after separating, gripping and lifting, rotated through about 90° into a perpendicular position and then swung overhead through about 180° and placed in the punching chamber 17. Here the swung-in stack 16 is deposited within the planes of the individual pieces of material standing perpendicularly in the insertion channel 14 and released by the stack holder 23 of the attachment. The swivel arm 19 can then swing back for the next work stroke.

Obviously, numerous modifications and variations of the present invention are possible in light of the above teachings. It is therefore to be understood that within the scope of the appended claims, the invention may be practiced otherwise than as specifically described herein.

I claim:

1. An automatic punching machine, comprising:

clamping means;

punching means held by said clamping means;

a horizontally movable press plate operative to press pre-cut stacked material past said punching means for punching of said stacked material;

a delivery channel extending beyond said punching means for receiving the punched stacked material;

a transfer station; and a gripping/lifting attachment disposed adjacent said delivery channel for gripping respective portions of said punched stacked material and transferring said material to said transfer station arranged a short distance away from said delivery channel, wherein said gripping/lifting attachment further comprises a swivel arm capable of swivelling overhead through about 180° and a swivel head arranged at the free end of the swivel and capable of pivotable movement through approximately 90°, so as to correctly orientate the gripped material for subsequent bundling, and wherein the transfer station to which portions of punched stacked material are delivered further comprises a lifting table and means for lowering said lifting table out of a plane of further conveyance so as to not interfere with the delivery.

2. An automatic punching machine as set forth in claim 1 wherein the gripping/lifting attachment further comprises at its free end a parting knife and a stack holder movable towards said parting knife for separating and gripping selected portions of punched stacked material.

3. An automatic punching machine as set forth in claim 2 wherein said parting knife has a cutting edge and which further comprises a protruding expanding mandrel adjustably arranged on said cutting edge for initial separation of layers of stacked material.

4. An automatic punching machine as set forth in claim 1 wherein said delivery channel further comprises two outwardly inclined flanks, and further comprising a plurality of adjustable guide rods arranged extending along one of said flanks inside said channel for guidance of the punched stacked material.

5. An automatic punching machine as set forth in claim 4, further comprising restraining means associated with said delivery channel in the region of said gripping/lifting attachment, said restraining means being adjustable into a predeterminable spacing with regard to said channel flanks and operative to restrain the punched stacked material that is to be gripped and lifted away by the gripping/lifting attachment.

6. An automatic punching machine as set forth in claim 4 wherein a holding-flat device is associated with one of said guide rods.

7. An automatic punching machine as set forth in claim 6 wherein said holding-flat device further comprises a hollow guide rod having a slot, a spring extending inside said hollow guide rod, and a bolt acting against said spring and projecting from and being guided in said slot.

8. An automatic punching machine as set forth in claim 1 wherein said delivery channel has an initial section sloping downwards from said punching means to a central section and an end section sloping upwards from said central section towards said gripping/lifting attaching, initial section and said end section each extending at an angle of between 10° and 20° to said central section.

9. An automatic punching machine as set forth as in claim 1 wherein said transfer station further comprises a frame for traveling in a plane of further conveyance, and wherein said lowerable lifting table is connected to said frame.

10. An automatic punching machine as set forth in claim 9 further comprising holding magnets for connecting said frame and said lifting table and further comprising a lifting cylinder for moving said lifting table relative to said frame.

11. An automatic punching machine as set forth in claim 10 further comprising retaining rods for retaining the punched stacks of material delivered to said transfer station and which are provided on the upper surface of said lifting table and wherein a plurality of coupling pins for coupling with said lifting cylinder are provided on the under surface of said lifting table.

12. An automatic punchng machine as set forth in claim 11 wherein said lifting cylinder further comprises a coupling piece having coupling slots extending transversely to the working direction of said cylinder and open at a side remote from said gripping/lifting attachment.

* * * * *